US008277139B1

(12) United States Patent
Deans et al.

(10) Patent No.: US 8,277,139 B1
(45) Date of Patent: Oct. 2, 2012

(54) HAND-HELD COSMETIC POWDER APPLICATOR BRUSH APPARATUS

(75) Inventors: David M. Deans, Woodland Hills, CA (US); Jacky L. Gunter, Westlake Village, CA (US); Jacquelyn I. Medina, Northridge, CA (US)

(73) Assignee: David M. Deans and Jerilyne T. Deans Co-Trustees for the David and Jerilyne Deans Family Trust, Woodland Hills, CA (US)

( * ) Notice: Subject to any disclaimer, the term of this patent is extended or adjusted under 35 U.S.C. 154(b) by 0 days.

(21) Appl. No.: 12/840,175

(22) Filed: Jul. 20, 2010

Related U.S. Application Data

(63) Continuation of application No. 11/981,938, filed on Oct. 31, 2007, now Pat. No. 7,775,737.

(60) Provisional application No. 60/954,381, filed on Aug. 7, 2007.

(51) Int. Cl.
*A47L 13/22* (2006.01)

(52) U.S. Cl. ..... 401/281; 401/280; 401/290; 401/117

(58) Field of Classification Search ..... 401/270, 401/277, 280, 281, 282, 290, 291, 200, 204, 401/205, 117
See application file for complete search history.

(56) References Cited

U.S. PATENT DOCUMENTS

| | | | | |
|---|---|---|---|---|
| 1,182,235 | A | 5/1916 | Amrock | 15/184 |
| 3,390,941 | A * | 7/1968 | Weber | 401/205 |
| 4,930,922 | A * | 6/1990 | LaRosa et al. | 401/281 |
| 5,339,483 | A | 8/1994 | Byun | 15/184 |
| 6,234,181 | B1 | 5/2001 | Lou | 132/313 |
| 6,932,533 | B1 | 8/2005 | Chen | 401/281 |
| 7,275,885 | B2 | 10/2007 | Byun | 401/280 |

* cited by examiner

*Primary Examiner* — David Walczak
(74) *Attorney, Agent, or Firm* — Hayes Soloway P.C.

(57) ABSTRACT

A hand-held cosmetic powder applicator brush apparatus for applying cosmetic powders such as facial powders and other powders to a user. The brush apparatus comprises a housing having a chamber for holding a powder to be dispensed and a valve mechanism for selectively opening and closing the chamber to a brush mounted on the housing so that powder in the housing may be dispensed to the bristles of the brush. The valve is operable by rotating an upper housing section such as a sleeve on the housing in a first direction to cause such opening. When the brush is not used, the upper housing section is rotated in the opposite direction to cause the valve mechanism to close. There is also a shield which extends around a portion of the brush to engage and protect the bristles when an outer cap is placed over the brush.

20 Claims, 10 Drawing Sheets

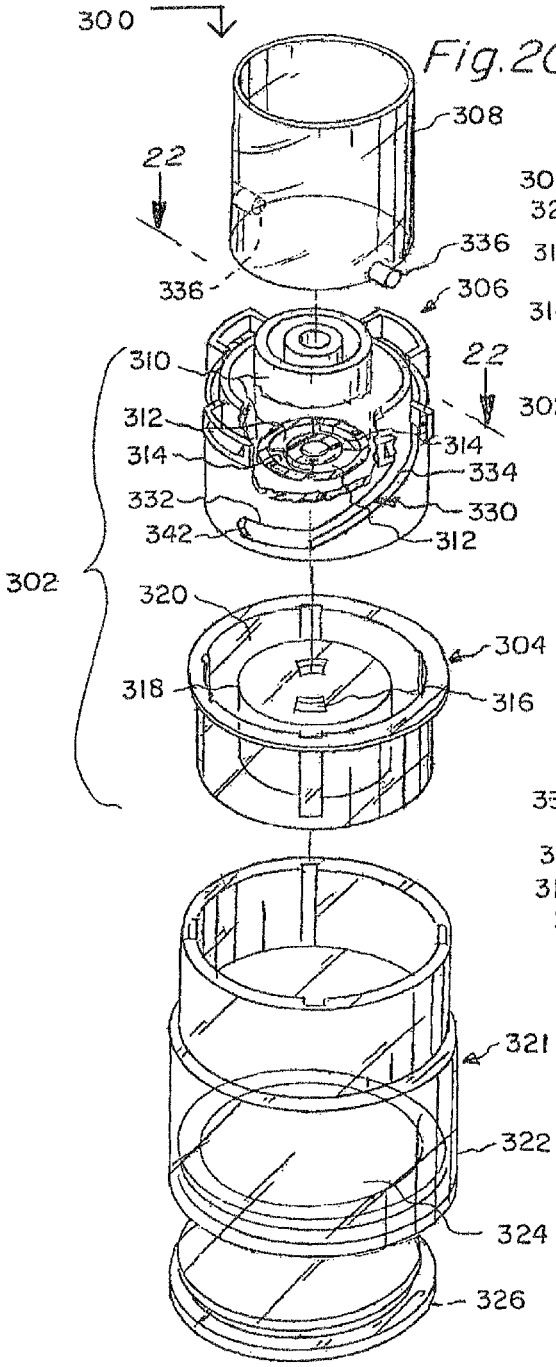
Fig. 20,
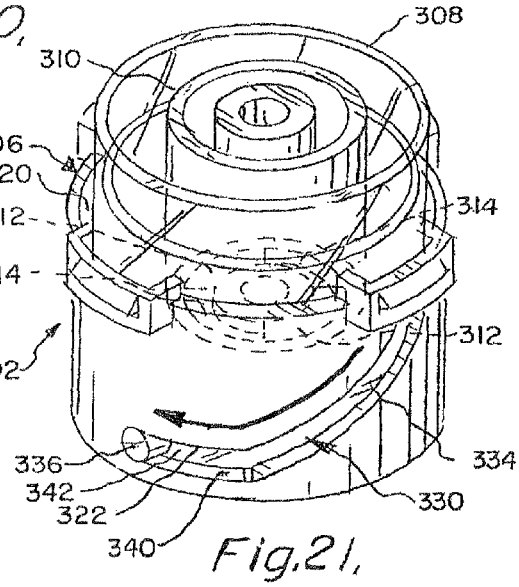
Fig. 21,
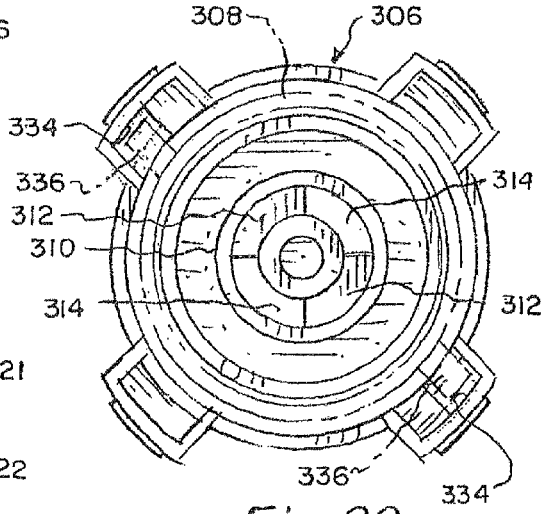
Fig. 22.

HAND-HELD COSMETIC POWDER APPLICATOR BRUSH APPARATUS

RELATED APPLICATIONS

This application is a continuation of application Ser. No. 11/981,938, filed on Oct. 31, 2007, now U.S. Pat. No. 7,775,737, which is based on and claims priority to the filing date of our U.S. provisional patent application Ser. No. 60/954,381 filed Aug. 7, 2007 for Cosmetic Powder Application Brush, the full contents of which are incorporated herein by reference.

BACKGROUND OF THE INVENTION

1. Field of the Invention

This invention relates in general to certain new and useful improvements in a hand-held cosmetic powder brush applicator apparatus and more particularly, to a cosmetic brush applicator apparatus of the type stated which enables provision of a brush along with a supply of the cosmetic powder all in a single assembly and which also provides for protection of the brush when a cap is located thereon.

2. Brief Description of Related Art

It is well known that in the art of cosmetic application brushes and more particularly brushes of this type which are often sold under the name "Kabuki brush", that there are numerous problems and limitations associated with the use of such brushes. Frequently, those people attempting to apply cosmetic powder to their face or other body parts will typically carry the brush along with a separate powder containing source, such as a small container of facial powder. As a result, not only is the user confronted with the problem of carrying the brush, but he or she must also make provision for carrying a separate container of the cosmetic powder.

One of the simple but obvious problems in using a separate brush and source of powder is the necessity to provide a powder applicator brush and a separate powder container for the powder. This not only duplicates the necessity of dealing with two individual cosmetic items, but complicates the actual application of the facial powder. With this arrangement, one must attempt to dip the brush into the powder and apply that powder to the user's face. The user must also be careful to avoid any spilling of the powder, or otherwise creating a mess in the process of applying the powder to the user's face. Even where there is a slight inadvertence and some of the powder may spill, the user typically does not have those cleaning items necessary to clean up the spill that he or she may have created.

Although there have been numerous attempts to combine a brush with an assembly having a container holding the cosmetic powder, the prior art has resorted to a rather complicated and expensive means for applying the powder to the brush. As a simple example, in the Byun U.S. Pat. No. 6,418,939, there is a cylinder-powder holding container arrangement in which the cylinder is pushed actually inwardly into a body of the container and forces the powder through discharge openings at an end thereof. In effect, this construction uses a pressure pump arrangement to force the cosmetic powder to move into the bristles of the brush through a pumping action.

There are other devices which have been proposed in the prior art for applying a cosmetic powder to a user and which includes a means for storage of the brush when not in use. Other devices of this type provide a housing where a brush is slidably inserted into the housing when the brush is not in use. A device of this type is taught in the Choi U.S. Pat. No. 6,405,402. This device is limited in its usefulness in that one must still exercise substantial care when attempting to place a removable cap on the brush assembly.

When installing a cap on a brush apparatus, some of the bristles of the brush tend to bend slightly outwardly. When the ends of the bristles are engaged by an edge of the cap, the bristles are bent as the cap is installed on the brush housing. As a result, pushing of the cap over the brush assembly will often cause the edge of the cap to engage ends of one or more of the bristles and bend same, thereby aggravating the problem which the cap is designed to solve. However, heretofore there has not been any brush apparatus of this type which effectively precludes the damage to the bristles when applying a cap over the entire bristle assembly.

There has been a proposed applicator in which a brush is brought into contact with a cosmetic powder by bringing the tips of the bristles into contact with a stick type powder cake. However, the cosmetic is not evenly applied to the brush with this approach and will not be evenly applied to the face or other body portion of the user. In many cases, since the brush itself is carried apart from the container of cosmetic powder, the brush can become contaminated with foreign substances. Some of these substances when contacted with the powder will cause degradation to the powders, such as facial powder. As a result, this approach also is disadvantageous and one which is not favored by many users. One such arrangement of this type is taught in U.S. Pat. No. 7,228,864 to Tahara.

Another problem frequently encountered with the use of a cosmetic brush and a separate container for holding the powder is that of the container inadvertently opening. This would often cause a spilling of the powder into the purse or carrying bag or other carrying container of the user. In addition, and in some cases, the powder can be fairly expensive, thus resulting in a monetary loss to the user.

It would therefore be desirable to provide a cosmetic powder applicator apparatus in which a source of powder was available within the brush apparatus but only selectively applied to the bristles of the brush upon demand by a user and which also provides for covering of the bristles without damage to the bristles when not in use.

BRIEF SUMMARY OF THE INVENTION

A powder applicator brush for application of a cosmetic powder, usually to the face of the user, but also to other parts of the user's body. The brush apparatus of the invention comprises an elongate housing having an internal chamber for holding a cosmetic powder and which housing is also provided on one end with bristles for application of a powder to body portions of the user. A removable cap is designed to fit over the bristles when the brush apparatus is not in use and can be snap fitted to the container housing so that it is readily removable therefrom.

The chamber in the housing is provided with discharge openings leading to the bristles of the brush applicator apparatus. There is provided a valve mechanism associated with these discharge openings in order to control the discharge of a charge of powder to the bristles of the brush.

The valve means forming part of the brush apparatus may be a relatively simple valve means, as for example, apertures in a portion of the brush apparatus which holds the bristles as well as alignable apertures in the cosmetic powder chamber. Upon rotation of an actuable member on the housing, as hereinafter described, the apertures leading to the chamber and the apertures leading to the base of the bristles can be alignable so that powder in the chamber can pass through the aligned apertures into the bristles of the brush. In a preferred embodiment actuation of the actuable member is a turning action. The turning of this actuable member or actuator causes the opening and closing of the valve in order to enable the charge of cosmetic powder to be applied to the brush.

The movement of the actuable member, such as a rotatable section on the housing, will open and close the apertures in response to the movement thereof. In one embodiment of the invention, the degree of movement can be used to proportionally control the amount of powder discharged to the bristles of the brush apparatus, as hereafter described. As an example, rotation of e.g. 20° can allow a slight discharge of powder, rotation of e.g. 40° can allow a greater discharge, etc.

Although the discharge of the powder can be caused by rotating an actuable member on the housing, as aforesaid, it should be understood that the valve means could be provided with a larger number of apertures. The amount of rotation could also be regulated to open only a selected number of apertures to thereby control the amount of discharge of the powder. Thus, for example, by turning an actuable member on the housing for a limited distance, only a few of the aligned apertures would become aligned for a limited distance and hence, only a small discharge of powder would result. Further rotation would cause more of the apertures to become aligned. By selectively controlling the amount of discharge in response to the rotation of the actuable member, it is possible to control the desired amount of powder discharge.

The brush apparatus of the invention is also provided with a cylindrically shaped bristle protecting shield which is adapted to surround a portion of the bristles of the brush apparatus when the latter are not in use. This construction allows for the cylindrically shaped shield or sleeve to be located within a cylindrically shaped slot formed in an end of the housing. The shield can be engaged and pulled outwardly from the housing to surround and tightly engage the bristles of the brush. In this way, when a cap is inserted onto the housing over the bristles, there will be a reduced possibility of the edge of the cap engaging ends of the bristles and permanently bending these bristles. This will thereby reduce the possibility of damage to the bristles. In like manner, when it is desired to use the brush apparatus, the shield is retracted within the housing.

It should also be recognized that in accordance with the invention, the bristle protective shield could be raised and lowered out of the slot in the housing in response to rotation of the actuable member. The bristle protective shield could also be provided with a lip on its upper end for engagement by a fingernail or even a finger of the user. In this way, the user could pull the protective shield out of the slot in which it is disposed for protection of the bristles and where the shield can also be pushed back into the slot.

It is also possible to use an automatic mechanism for raising the shield so that it is disposed around the bristles and for lowering the shield back into the housing. By having a follower on the shield ride in a groove with a desired specific shape on the actuator, the rotation of the actuator will enable the shield to ride up and down. A threaded section on the interior of the actuable member and on a fitting surrounding the bristles can also be used to first raise the shield or lower the shield in response to a rotation of the actuable member. In addition, the same threaded sections could cause an opening and closing of the valve means to allow for a discharge of the cosmetic powder to the base of the bristles.

In another embodiment of the invention, it is not necessary to use a threaded section on either the shield or the housing. Rather, the degree of rotation of one element such as a valve body or an actuating member relative to the valve body would cause apertures to become aligned or move out of alignment. Thus, opening and closing of the valve means would effectively control the amount of powder discharge to the base of the bristles, as aforesaid.

One of the advantages of the brush apparatus of the invention is that it is relatively simple in construction and can be made at a relatively low cost. Moreover, because of the simplicity of construction, the brush apparatus is durable and can be reused by adding additional powder to the housing or even changing the powder. Moreover, it can be constructed as a highly attractive single compact-brush mechanism relatively small in size and easy to carry by a user.

This present invention thereby provides a unique and novel hand-held cosmetic powder brush applicator apparatus, which thereby fulfills all of the above-identified purposes and other purposes which will become more fully apparent from the consideration of the forms in which it may be embodied. A few of these forms is more fully illustrated in the accompanying drawings and described in the following detailed description of the invention. However, it should be understood that the accompanying drawings and this detailed description are set forth only for purposes of illustrating the general principles of the invention.

BRIEF DESCRIPTION OF THE DRAWINGS

Figure 1:
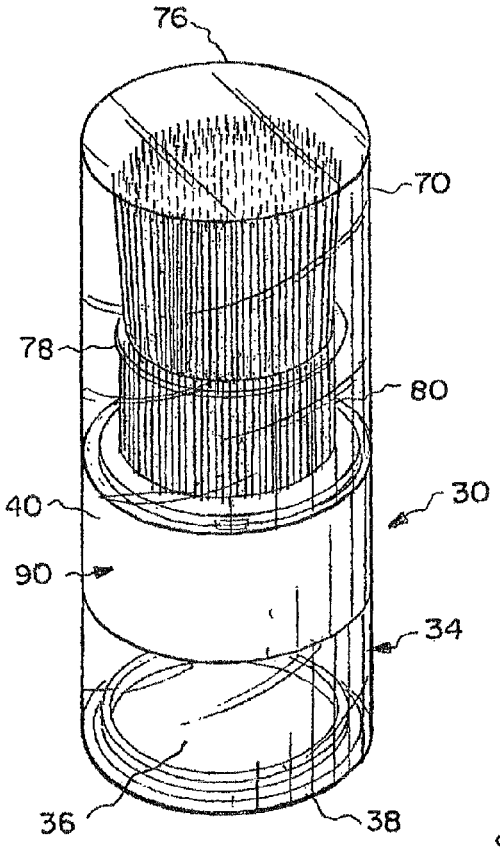
Figure 2:
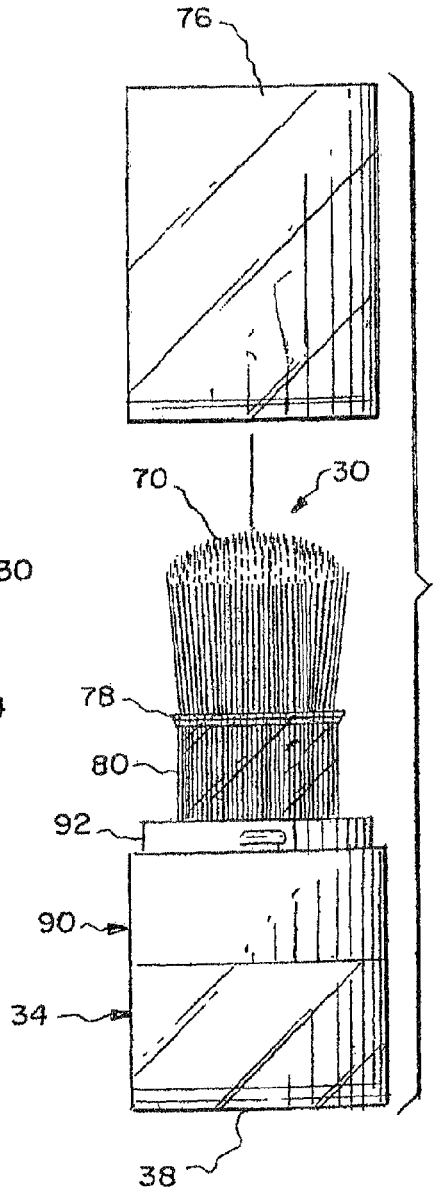
Figure 3:
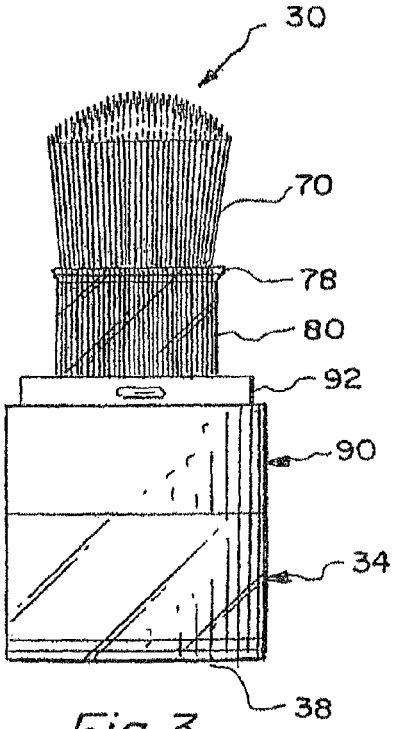
Figure 4:
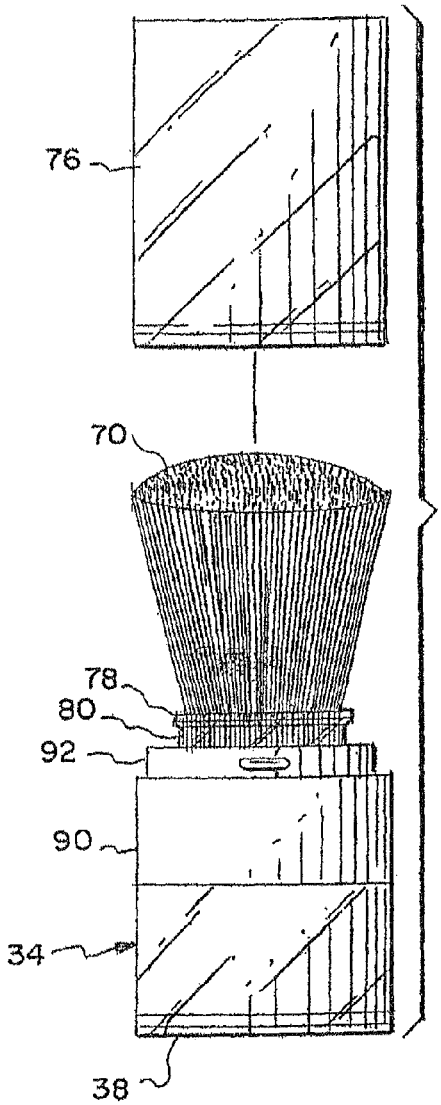
Figure 5A:
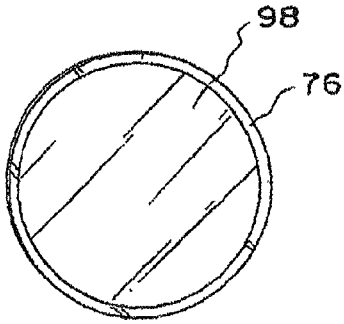
Figure 5B:
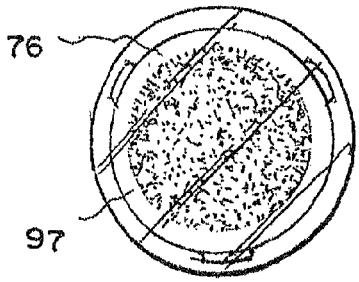
Figure 6:
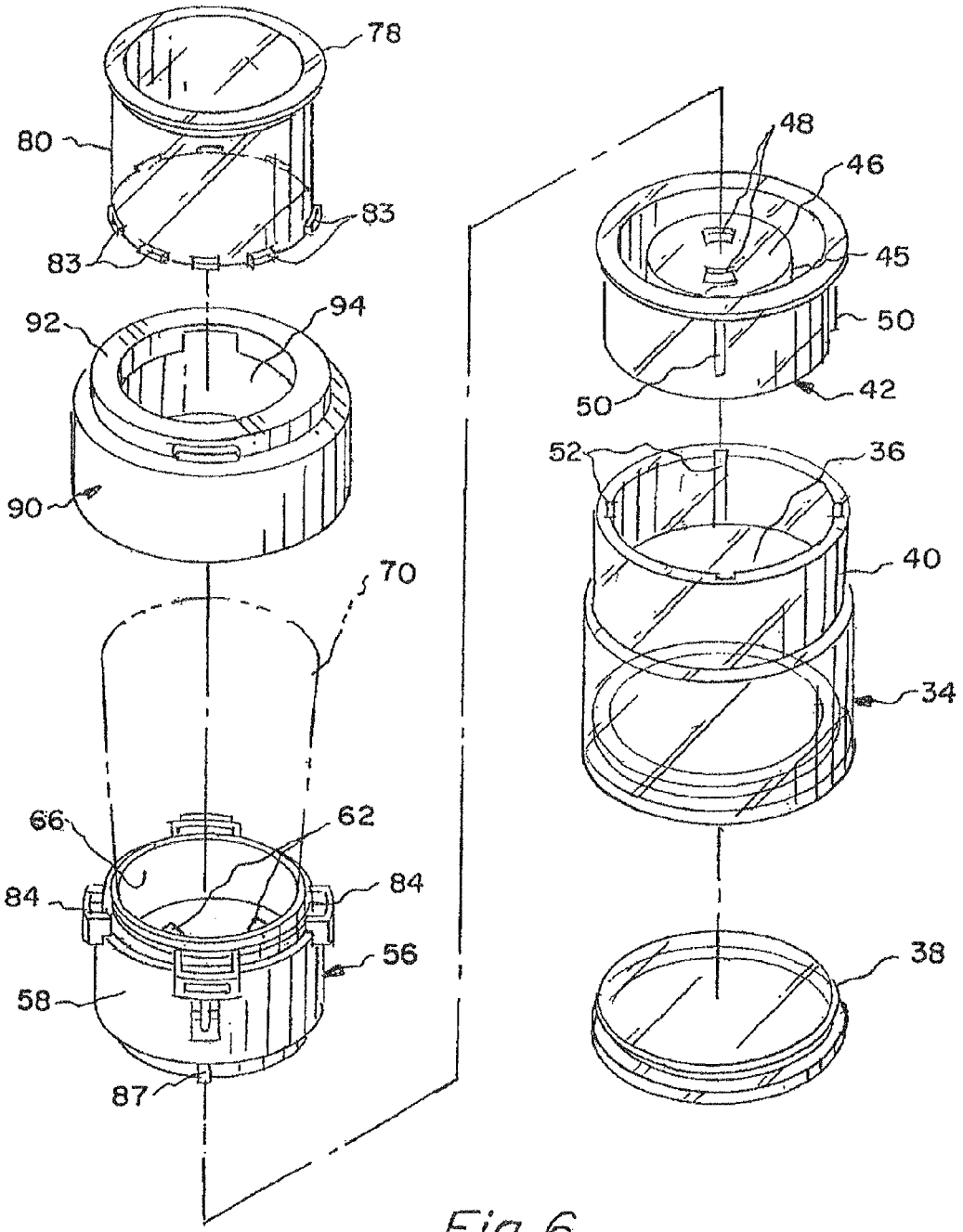
Figure 7:
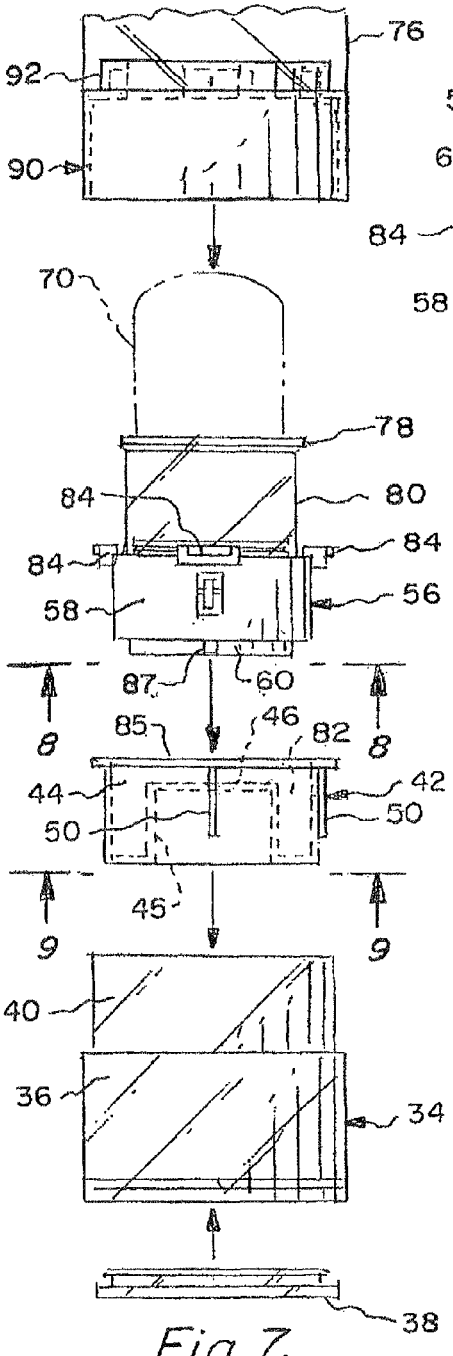
Figure 8:
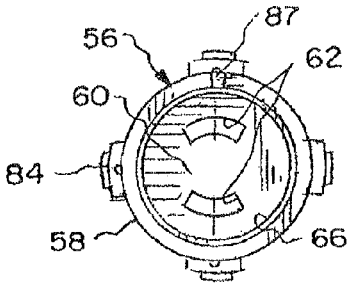
Figure 9:
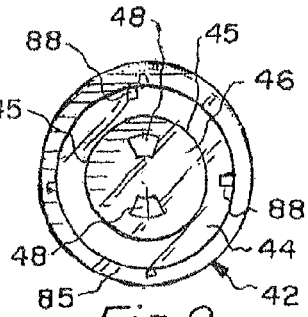
Figure 10:
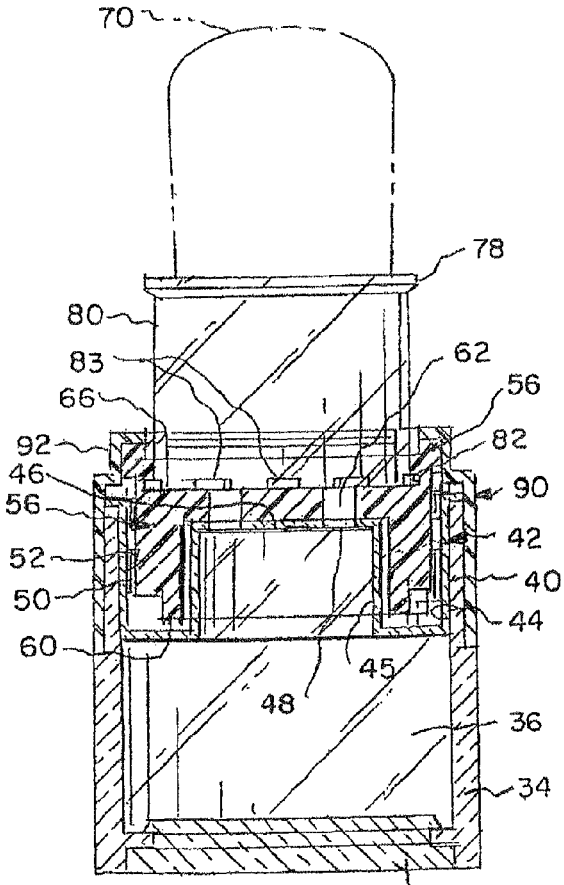
Figure 12:
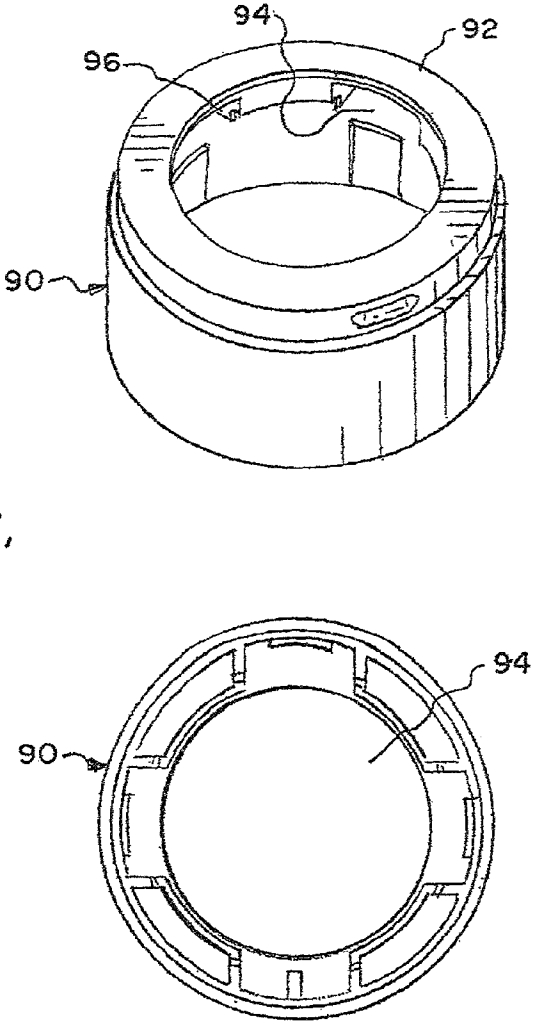
Figure 11:
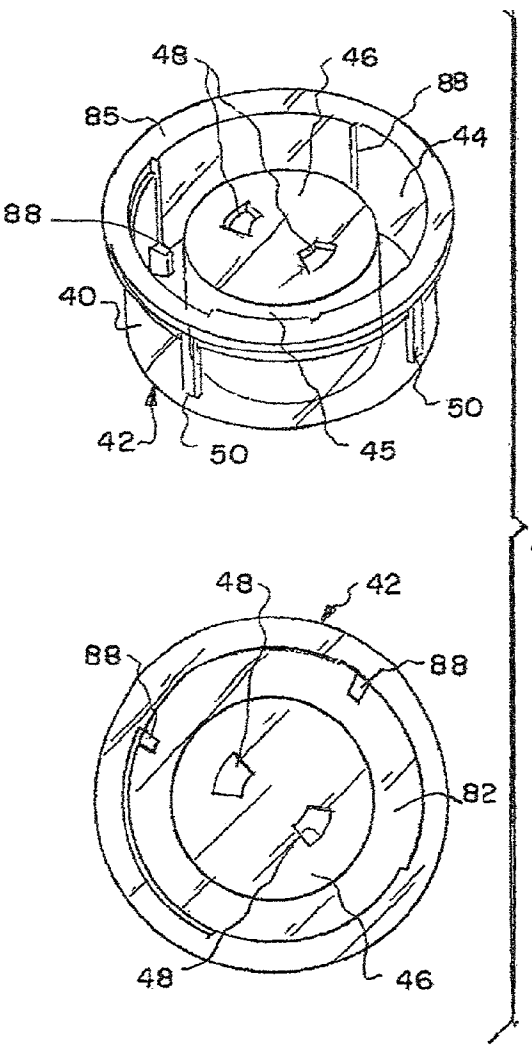
Figure 13:
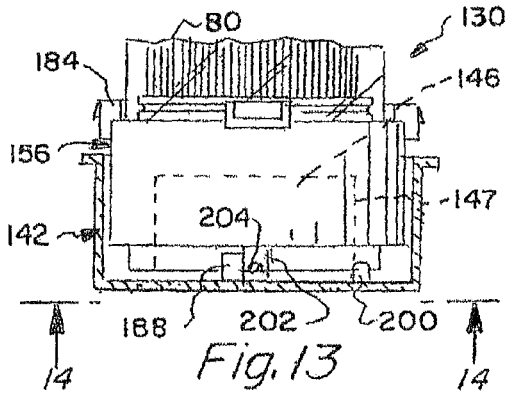
Figure 15:
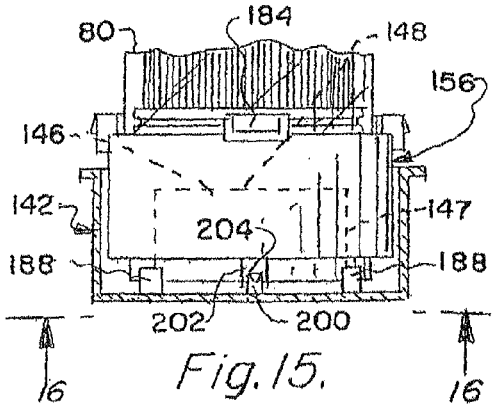
Figure 14:
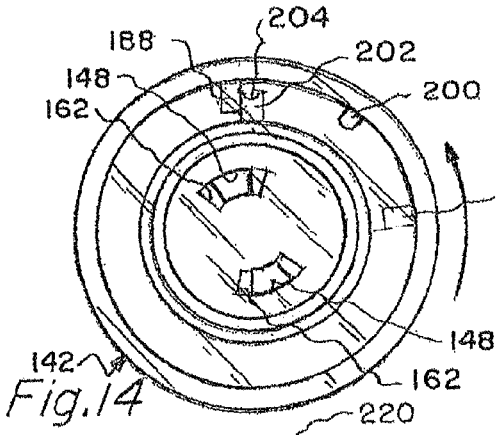
Figure 16:
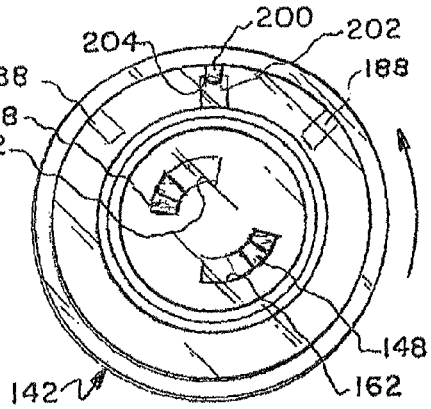
Figure 17:
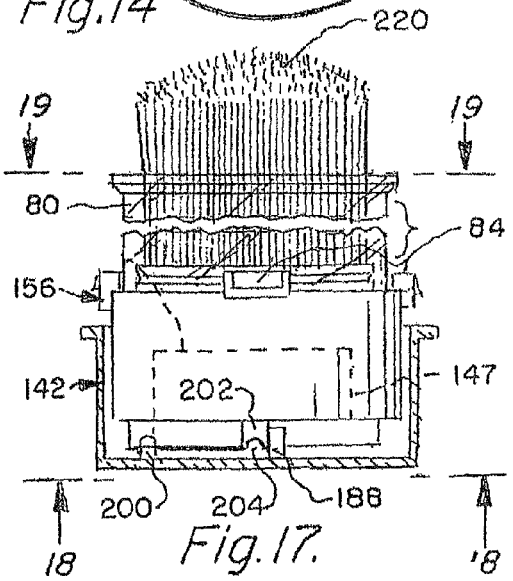
Figure 18:
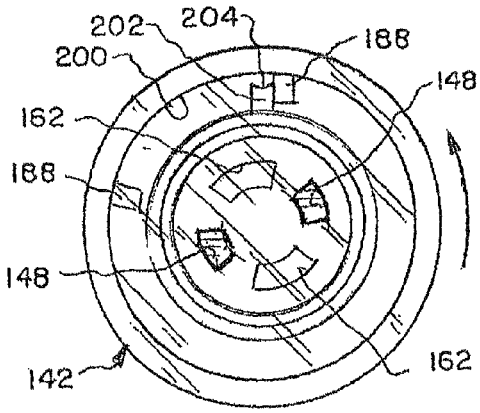
Figure 19:
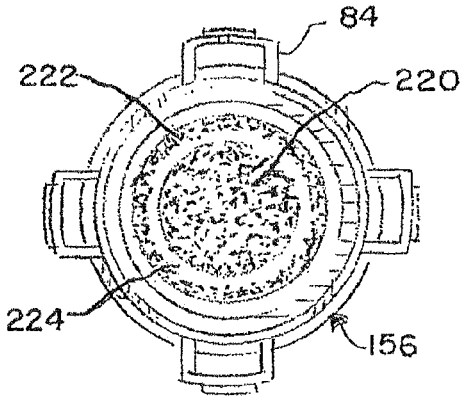
Figure 25:
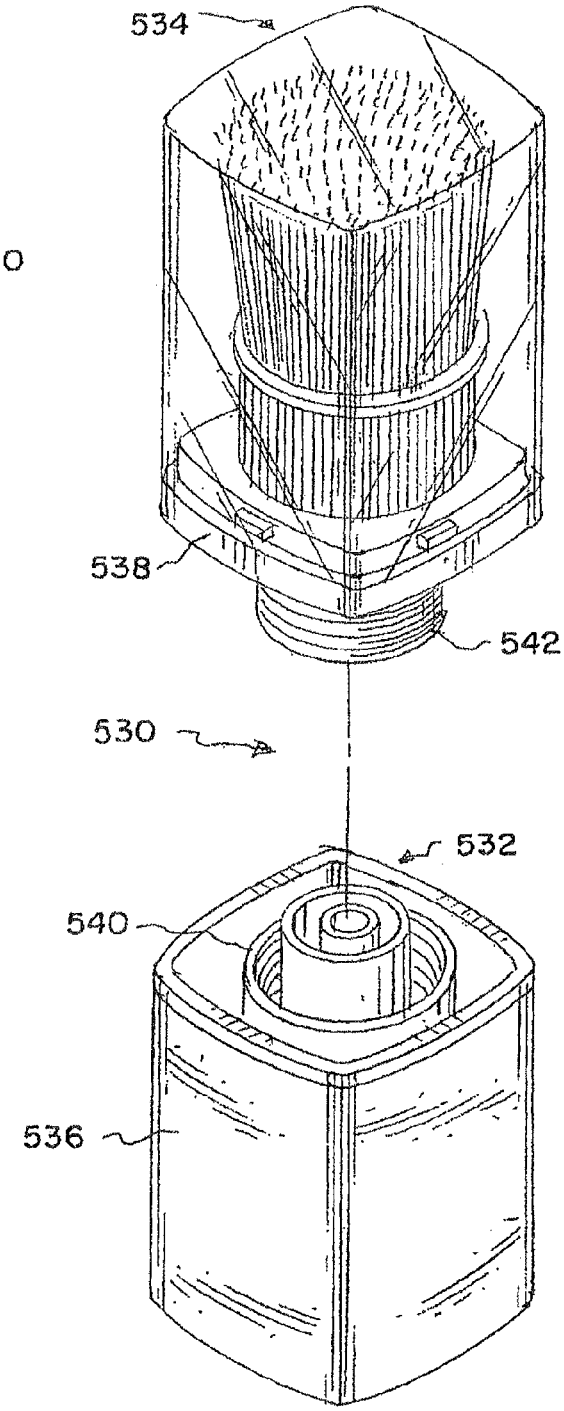
Figure 23:
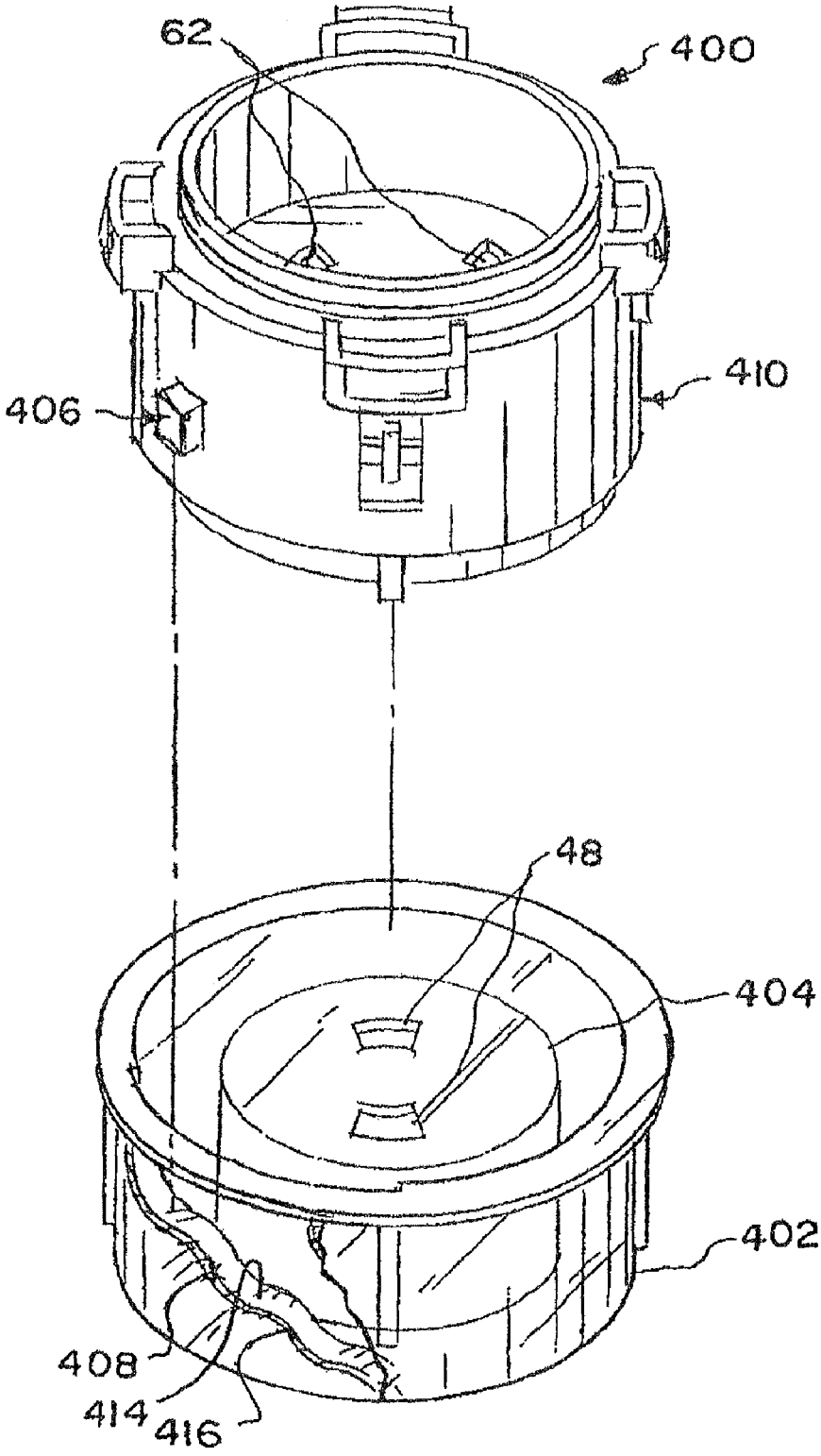
Figure 24:
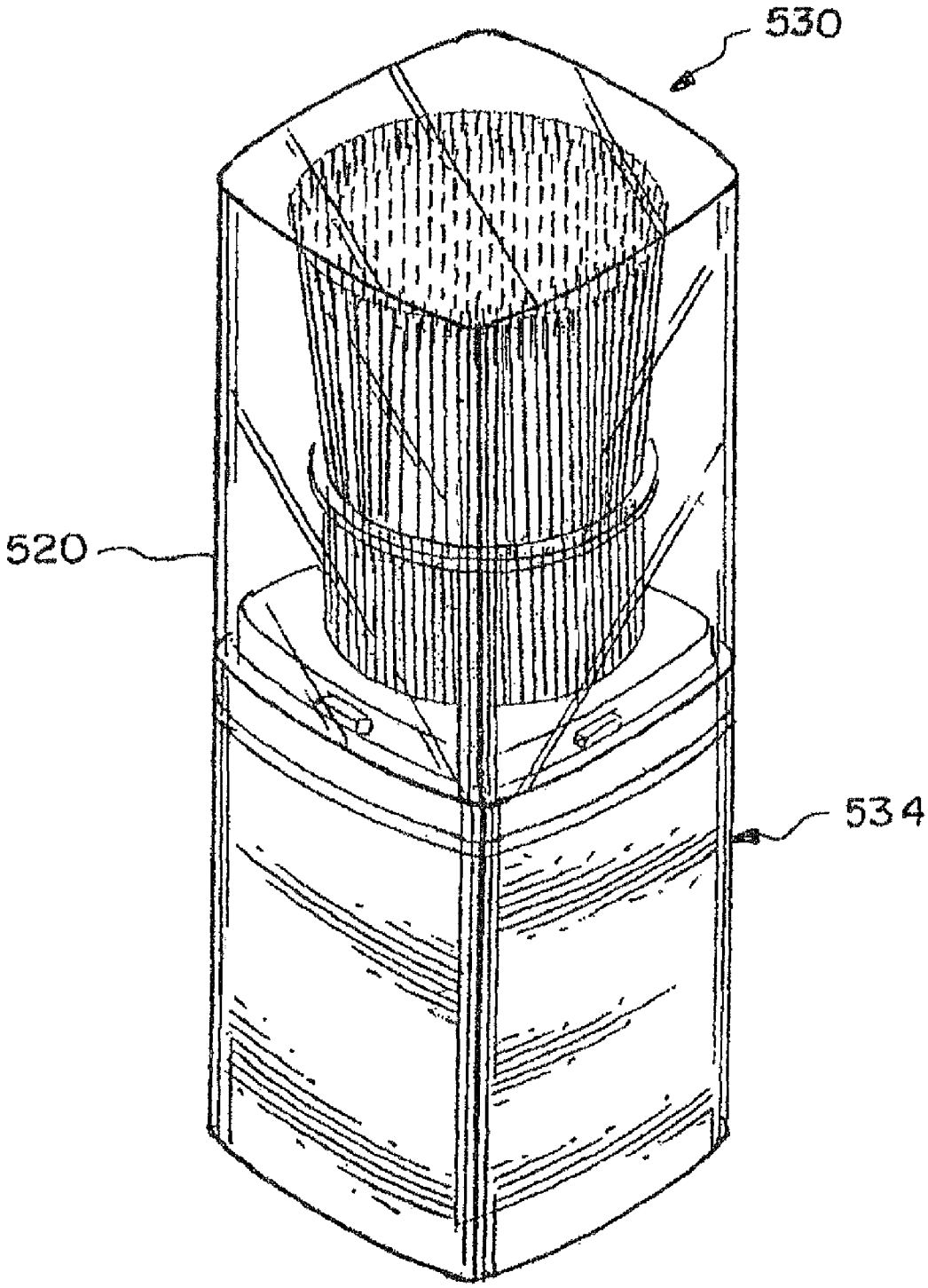

Having thus described the invention in general terms, reference will now be made to the accompanying drawings (ten sheets) in which:

FIG. 1 is a perspective view of one embodiment of a cosmetic powder brush applicator apparatus in accordance with the present invention;

FIG. 2 is an exploded side elevational view of the brush applicator apparatus and showing a portion of a cap removed from the housing of the apparatus of the invention;

FIG. 3 is a side elevational view of an embodiment of a cosmetic powder brush applicator apparatus without the use of a cap but with a bristle protective shield extended outwardly from ahousing of the brush apparatus and surrounding bristles of the brush applicator apparatus;

FIG. 4 is an exploded side elevational view of the brush applicator apparatus, somewhat similar to FIG. 2, but showing the bristle protective shield in a retracted position enabling the bristles to expand and the brush to be used;

FIG. 5A is a top plan view of one embodiment of the brush apparatus of the invention and showing a mirrored top portion on a cap of the apparatus;

FIG. 5B is a top plan view of a modified form of the brush apparatus of the invention and showing a transparent top portion of a cap used with the brush apparatus;

FIG. 6 is an exploded perspective view showing some of the main components of the cosmetic brush apparatus of the invention;

FIG. 7 is an exploded side elevational view showing the components forming part of the brush apparatus of the invention and in a position to show the assembly thereof;

FIG. 8 is a bottom plan view of an actuating sleeve forming part of the apparatus and taken along line 8-8 of FIG. 7;

FIG. 9 is a bottom plan view of a portion of a valve mechanism forming part of the apparatus of the invention and taken along line 9-9 of FIG. 7;

FIG. 10 is a vertical sectional view taken along an axial center-line of the brush apparatus of the invention and showing the assembled relationship of the components of FIG. 7;

FIG. 11 is an exploded somewhat schematic perspective combination view showing a portion of the valve mechanism along with a bottom view of the valve actuating mechanism of the present invention;

FIG. 12 is an exploded somewhat schematic perspective combination view showing portions of a valve actuating mechanism along with a bottom view of the valve actuating mechanism forming part of the brush apparatus of the invention;

FIG. 13 is a vertical sectional view, partially broken away, and showing a modified form of a valve and a valve actuating mechanism of a brush apparatus of the invention;

FIG. 14 is a bottom plan view taken along the plane of line 14-14 of FIG. 13;

FIG. 15 is a vertical sectional view, partially broken away, similar to FIG. 13, and showing the assembled components of FIGS. 13 and 15 when the one portion of the actuating mechanism has been rotated;

FIG. 16 is a bottom plan view taken substantially along the plane of line 16-16 of FIG. 15;

FIG. 17 is a fragmentary vertical sectional view taken along an axial center line of the brush apparatus as shown in FIGS. 13-18 and showing the components of FIGS. 13-18 and also specifically showing steps for limiting the degree of rotation of one member relative to another;

FIG. 18 is a bottom plan view taken substantially along the plane of line 18-18 of FIG. 17;

FIG. 19 is a somewhat schematic top plan view showing the bristle arrangement in the brush applicator apparatus of FIGS. 13-18;

FIG. 20 is an exploded perspective view of another modified form valve mechanism for opening and closing a three position valve and also raising and lowering a bristle protective shield in a modified brush applicator apparatus of the invention;

FIG. 21 is a perspective view of the components of FIG. 20 in assembled relationship;

FIG. 22 is a horizontal sectional view taken along line 22-22 of FIG. 20 and showing the coalition between a valve mechanism and an actuator in the apparatus of FIG. 20;

FIG. 23 is an exploded perspective view also showing the operation of the valve mechanism and actuator in still another modified form of brush applicator apparatus in accordance with the invention;

FIG. 24 is a perspective view of still a further modified form of the brush applicator apparatus (with different exterior configuration) in accordance with the present invention; and FIG. 25 is a fragmentary exploded perspective view showing a portion of the apparatus of FIG. 24 and the connection between two components thereof.

DETAILED DESCRIPTION OF PREFERRED EMBODIMENTS

Referring now in more detail and by reference characters to the drawings, FIGS. 1-12 illustrates a circularly shaped cosmetic powder brush applicator apparatus 30 for applying a powder, such as cosmetic powder, to a body of a user, and particularly, the face of the user.

FIGS. 13-19, as hereinafter discussed, illustrate an embodiment of the invention where the amount of powder discharge can be selectively varied by a user of the apparatus. FIGS. 20-22 illustrate an embodiment of the invention where there is available, at the option of the user, a limited discharge amount of the powder, or a larger discharge amount of the powder, as well as an off position where there is no powder discharge. A mechanism for automatically raising and lowering a bristle protective shield is also provided.

FIG. 24 illustrates a very similar brush apparatus 530 which is essentially similar to the brush apparatus 30 except that it has a slightly different exterior shape. Since the mechanism used for operating the brush apparatus 530 of FIG. 24 can be essentially any of the same mechanism as those in the apparatus 30, no separate mechanism will be described for the brush apparatus 530 of FIG. 23.

In the following described embodiment of a hand-held brush apparatus 30 of the invention, there is provided, among the other components, a bristle protective shield and a valve mechanism for dispensing cosmetic powder from a chamber in the apparatus to the bristles of a brush. In this embodiment of the apparatus, the bristle protective shield can be manually raised merely by engaging edges of the shield and pulling the same upwardly and it can be lowered by pushing the same inwardly into the housing of the apparatus. In addition, there is a two position valve mechanism, namely off and on, such that either the powder is precluded from being dispensed when in the off position or the valve mechanism is fully opened so that the powder can be dispensed in the on position.

FIGS. 1-12 more fully illustrate a modified form of a brush applicator apparatus. The hand-held brush applicator apparatus 30 is generally comprised of a base housing 34 having an interior chamber 36 which is provided for receiving a dispensable cosmetic powder or other type of powder. For this purpose, a bottom cap 38 is provided for covering the otherwise open bottom and leading to the interior chamber 36. The cap 38 may be removed for recharging the chamber 36 with powder, followed by reattachment of the cap. The actual means for attaching the cap 38 to the end of the applicator base housing 34 can vary depending on whether or not the cap is to be removable for recharging and reuse. In some cases, the cap may be snap fitted so that it is not necessarily removable. In other cases, a releasable snap fitting arrangement between the cap and the housing may be used.

The base housing 34 is integrally provided with an upper diametrically reduced section 40 (see FIGS. 6 and 7) and fitted within the open upper end of this diametrically reduced section 40 is a valve housing 42, as shown in FIGS. 6-10. The valve housing 42 is internally provided with an enlarged cylindrically shaped recess 82 (see FIGS. 7, 9, 10 and 11) with an upwardly struck further diametrically reduced boss 45 having an upper flat surface 46. Moreover, the upper flat surface 46 has a plurality of dispensing apertures 48 which are in communication with the interior powder receiving chamber 36 of the housing 34 and, particularly, in communication with the cosmetic powder contained within that housing.

The valve housing 42 has elongate vertically arranged projections 50 on its exterior side walls and which fit within corresponding recesses 52 formed in the interior side wall of the diametrically reduced section 40 of the housing 34 (see FIG. 6). In this way, the valve housing is held in position in the housing, but the actuator is still allowed to rotate a limited distance to achieve alignment of the apertures 48 and 62. Thus, the dispensing apertures 48 can selectively remain in communication with the cosmetic powder located in the interior chamber 36 of the housing.

Rotatably disposed within the valve housing 42 is an actuating member 56 and which has a cylindrically shaped body 58, substantially as shown in FIGS. 6, 7, 8 and 10 of the drawings. Body 58 of the actuating member 56 is also provided with an interior cooperating valve plate 60 also having elongate arcuately shaped apertures 62 (see FIGS. 6,8) These apertures 62 can become selectively aligned with the apertures 48 merely by turning one of the base housing 34 and the actuating member 56 relative to one another. It can be seen that in this embodiment of the invention, the valve arrangement is either opened or closed. Rotation of the actuating member 56 will occur until the apertures 62 are fully aligned with the dispensing apertures 48 and rotation in the opposite direction will occur until the apertures 48 are fully closed.

The actuating member 56 is also integrally provided with the interiorly presented circularly shaped wall 66 which holds bristles 70 extending upwardly and outwardly therefrom. The bristles 70 may be prepared in the form of a plug at their lower ends so that they fit in the wall 66 of the actuating member 56 in the manner as shown in FIGS. 6, 7 and 10. When the actuating member 56 is disposed within the valve housing 42, it can be seen that the dispensing apertures 62 can become aligned with the apertures 48 in the valve housing. Moreover, it can be observed by reference to FIGS. 8 and 9 as well as FIGS. 11 and 12 that by rotating the actuating member 56 with respect to the valve housing 42, that the apertures will become aligned and rotation in the opposite direction causes them to become un-aligned.

Surrounding the interior wall 66 of the actuating member 56 is a cylindrically shaped shield 80 which is located within a cylindrically shaped slot or recess 94 formed in the collar 90 (see FIGS. 6 and 12) The shield 80 is capable of shifting upwardly and downwardly with respect to the bristles 70 forming part of the brush. Thus, when the shield 80 is raised to the position as shown in FIGS. 1-3, it will tightly gather the various bristles and hold them into a compact plug like arrangement so that a cap 76 may be disposed over the bristles and become releasably secured to the base housing 34 without damaging the bristles. In like manner, the cap 76 may be removed and the shield lowered, permitting the bristles to expand somewhat as shown in FIG. 4.

It can be observed by reference to FIG. 3 that when the protective shield 80 is pulled outwardly with respect to the housing that it will tightly engage each of the bristles causing them to gather in the form of a small diameter plug. However, when the shield 80 is lowered back into the housing 34, in the manner as shown in FIG. 4, the bristles will be permitted to expand. For purposes of engaging the shield 80, an exterior flange 78 is formed at the upper end of the shield 80 for engagement of same. The lower end of the cylindrically shaped side wall of the shield is provided with a plurality of circularly located outwardly projecting elements 83 (see FIG. 6) which engage and preclude removal of the shield 80 from the actuating member 56.

By reference to FIGS. 8 and 9, it can be observed that when the actuating member has been rotated to a point, the dispensing apertures 48 are no longer in alignment with the dispensing apertures 62. As a result, the chamber will be completely closed and precludes dispensing of powder to the bristles 70 of the brush. By further reference to FIGS. 6-8 of the drawings, it can be observed that the body 58 of the actuator 56 is provided with a plurality of outwardly projecting lugs 84 at its upper end. These lugs will engage and ride upon an annular upwardly presented surface 85 of the valve housing 42 (see FIGS. 7-9). Moreover, they provide a limit to the degree of rotation of the actuating member 56 with respect to the valve housing 42 by engagement with projections 96 on an outer cover or collar 90, the latter of which also has a relatively flat circularly shaped upwardly presented surface 92. The collar 90 will also fit over and is disposed about the actuating member 56.

At its lower end, the actuating member is provided with a radially outwardly projecting stop 87, as shown in FIG. 8 and which is engageable with each of a pair of inwardly projecting abutments 88 located on the interior of the valve housing 42, all in the manner as best shown in FIGS. 8, 9 and 11. This stop 87 will engage the abutments 88 and thereby provide a limit of rotation of the actuating member with respect to the valve housing.

The cap 76 is provided with a top wall 97 which is integral with the cap and formed of the same material as the remainder of the cap. Preferably, the cap is somewhat transparent so that one can observe the bristles on the inside of the cap, as shown in FIG. 5B. In FIG. 5A, there is a modified embodiment in which the top of the cap is provided with a mirror 98. Thus, a user has the availability of a protected brush, a source of powder and a mirror all in one apparatus.

FIGS. 13-19 more fully illustrate a modified form of hand-held cosmetic powder applicator brush apparatus 130 which is similar to the apparatus 30, except that it includes a modified form of valve mechanism which allows for the user to control the amount of powder discharge, as hereinafter described. In the valve mechanism of the applicator apparatus 130, many of the components are similar to the components in the applicator apparatus 30, except that the reference numerals in this embodiment of the applicator apparatus 130 will include reference numerals in the 100 series of numbers. Thus, as an example, the applicator apparatus 30 previously described is identified in this new embodiment of FIGS. 13-19 as the applicator apparatus 130.

This modified form of brush applicator apparatus 130 will enable selective dispensing of a desired amount of the cosmetic powder, as aforesaid. In the previously described apparatus as shown in FIGS. 1-12, the apparatus was provided with stops or abutment elements which limited the degree of rotation. Hence, a fixed amount of powder was discharged each time the actuating member 56 was rotated. This construction of the valving arrangement in the apparatus 30, as shown in FIGS. 1-12, allows for a simpler construction with lower cost. In this embodiment of the apparatus 130 of FIGS. 13-19, a selected amount of dispensed cosmetic powder can be obtained in accordance with the desire of the user.

In the brush applicator apparatus 130, shown in FIGS. 13-19, there is provided an actuator or actuating member 156 and a valve housing 142. The valve housing 142 is similarly provided with an upstanding boss 147 having a flat top wall 146. This top wall 146 is similarly provided with apertures 148, which will become alignable with a apertures 162 in the actuator 156, as shown in FIGS. 14, 16 and 18. In this way, the valve mechanism can be opened and closed much in the same manner as previously described. However, in this embodiment of the invention, the base of the actuator 156 is provided with outwardly extending projections 202 which engage like projections 188 on the valve housing 142 and thereby fully limit the degree of rotation.

The brush applicator apparatus 130 is constructed so that the top wall 146 has the bottom of the bristles mounted therein. In addition, the bristles are also mounted so as to surround the boss 147. In this way, there is actually a space or channel between outer rows of bristles and bristles extending upwardly from the flat top wall 146. This construction has been found to be highly effective and almost necessary depending upon the type of powder which is used.

In some cases, and because of the fineness of the powder, it tends to agglomerate in such a manner that it will not actually dispense through the bristles of the brush and will collect at the very base of the bristles. However, it has been found that this slight air space enables the powder to pass around the bristles of the brush at the base of the bristles so that the bristles themselves can become impregnated with the powder. Thus, this arrangement allows the powder to flow freely under the brush and around the bristles. In effect, it has been found that it is necessary to have this air pocket between the interior bristles and the outer bristles surrounding those on the interior in order to achieve not only the flow of powder, but a widely dispersed flow of powder.

By reference to FIG. 19, it can be observed that there is an inner core or bunch of bristles 220 in somewhat of a circularly arranged pattern and surrounded by outer rows of bristles 222 with a cylindrically shaped space 224 therebetween. This space 224 constitutes an air space or channel which precludes the agglomeration of the powder and permits the powder to be disbursed and flow around the bristles. In one embodiment, the space or channel is at least as wide as the row of outer bristles.

With regard to FIGS. 13-19, in this embodiment of the apparatus 130, the valve housing is also provided with a plurality of upstanding peripherally arranged upwardly projecting abutments 200 which have rounded upper tips and are engageable with like depending abutments 202 on the actuator. The abutments 202 have somewhat rounded recesses 204 which receive the rounded ends of the upward projections 200, as shown, for example, in FIG. 15. This will provide a series of annular stops, such that a desired degree of rotation between the valve actuator and the valve body can be achieved as shown in FIG. 17. In this way, there will be the rounded tips 204 on the projections which allow a plurality of intermediate stops in the rotation of the actuator with respect to the valve housing 142.

The projections or fingers 200 which engage the notches 204 effectively provide "stops" which may temporarily stop the degree of rotation thereby alerting the user to the fact that this represents a fixed opening position. In other words, the user can stop at that position by sensing a slight increased resistance, or continue to rotate in order to obtain a greater aligned degree of the apertures 148 and 162. Thus, several stops can be provided to obtain a desired opening size by controlling the overlapping arrangement of the respective apertures 148 and 162.

The actuating member 156 is provided at its upper end on the exterior of its side wall with a plurality of outwardly extending rotation limiting projections or lugs 184 as best shown in FIGS. 13-19. These projections 184 will engage with elongate ribs on the interior of the valve housing 142 and thereby fully limit rotation of the actuating member. Thus, it is only necessary for the actuating member to rotate a limited distance between a fully opened and a fully closed position. It should be understood, however, that it is also possible to increase the degree of rotation. FIG. 14 shows the respective positions of the apertures 162 and 148, such that they are fully open. FIG. 18 shows the respective positions of the apertures 162 and 148 when the valve mechanism is fully closed. FIG. 16 shows the apertures 162 and 148 where the valve mechanism is partially opened. Again, it should be understood that by increasing or decreasing the degree of rotation, it is possible to provide additional partial valve opened positions of lesser or greater degrees of valve openings.

At its lower end, the actuating member 156 is provided with an outwardly projecting lug 202 which engages a projection 188 on the interior of the valve housing 142 as shown in FIGS. 13 and 14. Obviously, the degree of rotation of the actuating member could be further limited as desired.

The following described embodiment of the invention, constituting a modified form brush applicator apparatus 300, is more fully illustrated in FIGS. 20 through 22. This modified applicator apparatus 300 is provided with yet another modified form of actuating mechanism and valve arrangement 302. This modified form of actuating mechanism and valve arrangement 302 allows for an automatic raising of a bristle protective shield as hereinafter described and also allows for a three position valve mechanism. The first position of that valve mechanism is fully off in which no powder is dispensed. The second position allows for a low amount of powder discharge and the third position allows for a high amount of powder discharge.

The actuator and valve arrangement 302 generally comprises an cutter 306 and a valve body 304, substantially as shown in FIGS. 20-22 of the drawings. In this case, the valve arrangement operates with a bristle protective shield 308 which will extend outwardly of the housing and about the bristles when the valve is closed and no powder is discharged to the bristles. However, when the protective shield which extends about the bristles, is shifted inwardly within the housing, then the valve is in a position to open to either a low powder discharge position or a high powder discharge position, as hereinafter described. The actuator 306 has an interior upwardly presented boss 310 with an upper flat surface 312. Moreover, mounted on that upper flat surface are a pair of discharge apertures 314 (FIGS. 20-22). These discharge apertures 314 operate in combination with similar discharge apertures 316 (FIG. 20) contained in valve body 304. When the pairs of apertures 314 and 316 are aligned, and fully aligned, then the valve will be fully opened and a maximum amount of powder can be discharged. When the discharge apertures 314 are only partially aligned with the discharge apertures 316, then there will be only a low discharge of powder.

The discharge apertures 316 in the valve body 304 are also formed in an upstanding internally located boss 318 which effectively mates with the boss 310 in the actuator 306. There is provided a recess 320 which receives the actuator 306 formed in the valve body 304. In this way, the pairs of discharge apertures 314 and 316 can become aligned by rotation of the actuator 306 within the valve body 304.

The actuating mechanism and valve arrangement 302 actually fits within an outer sleeve 321 which is sized to receive it. This sleeve includes a bottom housing 322 which contains an internal chamber 324 for receiving the cosmetic powder. There is further provided a bottom lid 326 which snaps over an open lower end. Any suitable snap fitting arrangement allowing for the snap fitting of the lid to the housing 322 can be provided for this purpose.

There is provided on the interior surface of the actuator 306 a recess 330 which has a horizontal portion 332 and a vertically arranged somewhat arcuate portion 334. There is also a similar recess 330 on the opposite side of the actuator sleeve 306. A pair of lugs or so-called "followers" 336 extend outwardly from the shield 308 and are designed to fit within the recesses or grooves 330. Thus, as the shield is rotated relative to the actuator sleeve 306, the followers 336 will ride in the recesses 330.

When the actuator sleeve 306 rides in the partially vertically arranged portion 334 of the recess 330, it will cause a raising or a lowering of the shield 308. When the lug or follower 336 reaches the upper end of the arcuate somewhat vertically arranged groove portion 334, the shield 308 will be extended upwardly out of the housing and about the bristles of the brush to protect same. When the followers 336 reach the lower end of the groove 320 toward the bottom of the arcuately shaped portion 334, the actuator will be lowered at which point the valve openings can be aligned to permit a discharge. There is a first position 340 toward one end of the horizontal slot portion 332 representing a small discharge. At this point, the discharge apertures 314 and 316 are only partially aligned to thereby enable the discharge of a minimum amount of cosmetic powder. When the shield 308 is further rotated, or otherwise when the boss 310 is further rotated, it will cause the follower to move to the full volume position 342 at the left hand end of the horizontal slot portion 332. In this position, the openings will be fully aligned thereby permitting discharge of a maximum amount of powder.

This embodiment of the invention 300 as shown in FIGS. 20 through 22 is deemed to be one of the most preferred embodiments inasmuch as it allows for a small amount of powder discharge and a larger amount of powder discharge. In most cases, the user will select either the minimum amount or the maximum amount or for that matter no powder at all. This mechanism also allows for the automatic opening of the shield to extend around the bristles and protect same when not in use FIG. 23 more fully illustrates a modified form of an actuating mechanism and valve arrangement 400 and which comprises a valve body 402 substantially similar in construction to the previously described valve body 42, except that it is provided with a groove 408 in valve body 402. The actuating mechanism and valve arrangement 400 having an actuator body 410 also has an outwardly projecting lug or follower 406 which rides within the groove 408 formed in valve body 402. In this way, the follower 406 will ride in the groove 408 and follow the course of that groove causing opening and closing movement of the valve body with respect to the actuator.

The actuator can actually cause such movement between a partially opened position, or fully opened position or any position therebetween. It can be seen that the groove 408 is provided with a plurality of horizontal areas 414 which are connected by arcuate bends 416. In this way, the follower 406 can ride in these various portions of the groove and when a follower reaches a flat portion, that represents a position where the aligned openings represent a certain discharge level. As the follower moves lower into a groove area, it will reach a fully opened position and at the uppermost position, the aligned openings will be closed.

It should also be understood that an additional step could be provided for raising and lowering the protective shield 80. In this way, the brush apparatus of the invention would become actuated merely by turning the actuating member between each of the individual steps on the outwardly extending projection or follower 406 and the receiving groove 408 therefore.

FIG. 24 illustrates the aforesaid modified embodiment of the cosmetic powder brush applicator apparatus 530. The main difference between this powder application brush 530 and the previously described brush apparatus 30 is that the brush applicator apparatus 530 is in the form of a rectangularly shaped housing. In this way, all the components on the exterior are rectangularly shaped, such as for example, a cap or lid 520 which is somewhat similar in construction to the cap 76, except for the shape thereof. However, it can be seen that most of the remaining components are essentially identical to those previously described and operate in the same manner.

Where it is necessary for one of the components to rotate relative to one or more other components forming part of the brush apparatus 30, those components can be cylindrically or circularly shaped. As a simple example, in the brush applicator apparatus 530 the valve body would be equivalent to the valve housing 42 and the actuator in the brush applicator apparatus 530 of FIG. 22 would have a shape similar to the cylindrical shape of the actuator 56.

As a simple example of the foregoing, FIG. 25 illustrates two components of the brush applicator apparatus 530 including, for example, a base S32 and an upper section 534. Both of these sections have rectangularly shaped portions 536 and 538 respectively. However, the lower portion has an upstanding cylindrically shaped boss 540 and the upper section 534 as a depending cylindrically shaped connector 542 which will connect with the boss 540. In this way, both sections of the cosmetic powder brush applicator apparatus will have a non-circular outer shape but will still operate with cylindrically arranged inner components.

The various components forming part of the cosmetic powder brush applicator apparatus of the invention including the base and components therein typically can be made from a variety of well known plastics and therefore can be produced at a relatively low cost. However, it should be understood that various components of any of the applicators could be formed of any of a variety of metals such as aluminum and would still be relatively light in weight. In addition, for durability, the various components of the apparatus could be formed of reinforced composite reinforced plastics. Moreover, and depending upon the group of potential purchasers, various adornments could be applied such as, for example, costume jewels and the like.

Thus, there has been illustrated and described a unique and novel hand-held cosmetic powder brush applicator apparatus, and which thereby fulfills all of the objects and advantages which have been sought. It should be understood that many changes, modifications, variations and other uses and applications will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what we desire to claim and secure by Letters Patent is:

1. A hand held cosmetic brush applicator apparatus for the application of a cosmetic powder, said brush applicator apparatus comprising:

a) a housing having a cosmetic powder retaining chamber in said housing;

b) a rotably actuated valve contained within said housing for permitting selective discharge of cosmetic powder from said chamber, said valve including a top wall having bristles mounted to the top wall such that the bristles have an outer perimeter, the bristles extending outwardly from said top wall such that the outer perimeter of the bristles increases with distance from the housing, and wherein the bristles are mounted to the top wall as an inner core of bristles and as outer rows of bristles with a cylindrically shaped air space therebetween, wherein the cosmetic powder can pass through the air space and distribute and flow around the bristles; and c) a shield shiftably mounted on said housing and extending outwardly from said housing and sized to surround a portion of the outer perimeter of the bristles when the brush is used, and which shield is adapted to be shifted to extend outwardly and compact the bristles.

2. The hand-held cosmetic brush applicator apparatus of claim 1 further characterized in that said housing comprises:

a) a slot having a shape of the shield; and b) said shield being slidably located in said slot and shiftable out of said slot to partially cover said bristles when the brush is not used and back into said slot when the brush is used.

3. The hand-held cosmetic brush applicator apparatus of claim 2 further characterized in that said brush applicator apparatus further comprises:

a) an outwardly extending finger engaging element on said shield for raising the shield out of the slot.

4. The hand-held cosmetic brush applicator apparatus of claim 1 further characterized in that said value selectively allows access to the cosmetic powder in the chamber upon demand by a user.

5. The hand-held cosmetic brush applicator apparatus of claim 1 further characterized in that said brush applicator apparatus further comprises a cap that may be inserted onto the housing, removably fitted over said bristles.

6. A hand-held cosmetic brush applicator apparatus for the application of a cosmetic powder and which selectively introduces an amount of powder into bristles of the brush applicator apparatus upon demand, said brush applicator apparatus comprising:

a) a base housing having a chamber for holding a cosmetic powder, and a diametrically reduced portion surrounding a rotatably actuated valve;

b) bristles arranged in concentric rows within said base housing and projecting outwardly from an end of said housing with at least one air space between rows; and c) a shiftable actuating collar surrounding the diametrically reduced portion of said base housing, such that the collar is substantially flush with the chamber of the base housing and coupled to the valve to enable an introduction of powder into a base portion of the bristles upon shiftable movement of said actuating collar; wherein:

said valve is openable and closable in a series of at least three annular stops in response to shiftable movement of said actuating collar, wherein each said stop corresponds to a different amount of powder that can be discharged from the housing.

7. The hand-held cosmetic brush apparatus of claim 6 further characterized in that:

a) the base housing of said brush applicator apparatus being a cylindrically shaped base housing;

b) said actuating collar is cylindrically shaped and lies substantially flush with the base housing.

8. The hand-held cosmetic brush apparatus of claim 7 further characterized in that:

a) said valve being situated to introduce powder into an air channel in the bristles.

9. The hand-held cosmetic brush applicator apparatus of claim 6 further characterized in that said brush applicator apparatus further comprises:

a) a threaded section on said shiftable collar engageable with a mating threaded section on said base housing causing at least a rotatable movement upon turning of said collar relative to said housing.

10. The hand-held cosmetic brush apparatus of claim 9 further comprising a shield operatively connected to at least one of said threaded sections and movable in response to rotatable movement relative to said housing.

11. The hand-held cosmetic brush apparatus of claim 6 further characterized in that said apparatus further comprises:

a) a shield on said housing and extending outwardly from said housing about said bristles upon movement of said actuating collar.

12. A hand-held cosmetic applicator apparatus for carrying a cosmetic powder which can be applied to a user with an applicator, said applicator apparatus comprising:

a) an outer housing;

b) a chamber in said housing and holding a cosmetic powder and also having a discharge aperture;

c) a rotable actuated valve associated with said discharge aperture for controlling the discharge of powder;

d) an actuator on said housing operable by a user for causing opening and closing of said valve to selectively discharge the cosmetic powder, and e) bristles forming a brush, mounted to a top wall of the valve, in concentric rows of bristles, with an air space between at least two adjacent rows of bristles, wherein the cosmetic powder can pass through the air space and distribute and flow around the bristles.

13. The hand-held cosmetic brush apparatus of claim 12 further characterized in that said valve is adapted to discharge said powder into the air space between the bristles.

14. The hand-held cosmetic applicator apparatus of claim 13 further characterized in that:

a) said valve is operable to allow for a limited discharge or a full discharge of powder or no discharge of powder.

15. The hand-held cosmetic applicator apparatus of claim 13 further characterized in that said applicator apparatus further comprises:

a) an aperture which will open and close in response to movement of said actuator and control the powder discharge in response to the movement of said actuator and thereby vary the amount of powder discharge selected by the user.

16. The hand-held cosmetic applicator apparatus of claim 12 further characterized in that said applicator apparatus further comprises:

a) an aperture which will open and close in response to movement of said actuator to provide only a specific selected amount of powder discharge in response to opening of said valve.

17. A hand held cosmetic brush applicator apparatus for the application of a cosmetic powder, said brush applicator apparatus comprising:

a) a housing having a cosmetic powder retaining chamber in said housing;

b) a rotably actuated valve contained within said housing for permitting selective discharge of cosmetic powder from said chamber;

c) bristles mounted to said valve and extending outwardly from said housing for receiving and temporarily retaining said cosmetic powder from said chamber to be applied to a user said bristles being divided into a concentration of some of the bristles to form a center section of bristles and an outer circularly arranged row of bristles surrounding the center section and separated therefrom by an air space, wherein the air space is in contact with bristles in both the center section and the outer row, and wherein the cosmetic powder can pass through the air space and distribute and flow around bristles in both the center section and the outer row of bristles.

18. The hand-held cosmetic brush applicator apparatus of claim 17 further characterized in that a large majority of said bristles are concentrated in the center section.

19. The hand-held cosmetic brush applicator apparatus of claim 18 further characterized in that said air space is at least as wide as the row of outer bristles.

20. The hand-held cosmetic brush applicator apparatus of claim 18 further characterized in that said brush applicator apparatus further comprises:

a) a shield being slidably located in a slot in said housing and is shiftable out of said slot to partially cover said bristles when the brush is not used and back into said slot when the brush is used.

* * * * *

UNITED STATES PATENT AND TRADEMARK OFFICE

CERTIFICATE OF CORRECTION

PATENT NO. : 8,277,139 B1
APPLICATION NO. : 12/840175
DATED : October 2, 2012
INVENTOR(S) : Deans et al.

It is certified that error appears in the above-identified patent and that said Letters Patent is hereby corrected as shown below:

In the Claims:

Claim 4, Col. 12, line 66, "value" should be --valve--.

Signed and Sealed this
Fourteenth Day of October, 2014

Michelle K. Lee

Michelle K. Lee
*Deputy Director of the United States Patent and Trademark Office*